US012545451B2

(12) United States Patent
Biondi et al.

(10) Patent No.: US 12,545,451 B2
(45) Date of Patent: Feb. 10, 2026

(54) PACKAGING DEVICE FOR PACKAGING ARTICLES INTO BOXES

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT)

(73) Assignee: R.A JONES & CO.

( * ) Notice: Subject to any disclaimer, the term of this patent is extended or adjusted under 35 U.S.C. 154(b) by 0 days.

(21) Appl. No.: 18/868,725

(22) PCT Filed: May 30, 2023

(86) PCT No.: PCT/IB2023/055529
§ 371 (c)(1),
(2) Date: Nov. 22, 2024

(87) PCT Pub. No.: WO2023/233291
PCT Pub. Date: Dec. 7, 2023

(65) Prior Publication Data

US 2025/0346382 A1 Nov. 13, 2025

(30) Foreign Application Priority Data

Jun. 1, 2022 (IT) ..... 102022000011699

(51) Int. Cl.
*B65B 11/00* (2006.01)
*B65B 5/02* (2006.01)
(Continued)

(52) U.S. Cl.
CPC ..... *B65B 11/004* (2013.01); *B65B 5/024* (2013.01); *B65B 11/10* (2013.01); *B65B 11/28* (2013.01); *B65B 43/10* (2013.01); *B65B 49/14* (2013.01)

(58) Field of Classification Search
CPC ..... B65B 5/024; B65B 11/004; B65B 11/06; B65B 11/10; B65B 11/28; B65B 11/30;
(Continued)

(56) References Cited

U.S. PATENT DOCUMENTS 3,507,091 A * 4/1970 Mizelle et al. ..... B65B 11/12 53/131.2
3,875,724 A 4/1975 Langen
(Continued)

FOREIGN PATENT DOCUMENTS

DE 19728750 A1 1/1999

OTHER PUBLICATIONS

International Search Report and Written Opinion for International Patent Application. PCT/IB2023/055529 filed May 30, 2023 on behalf of R.A Jones & CO.. Mailing Date: Dec. 7, 2023. 7 pages.

*Primary Examiner* — Stephen F. Gerrity
(74) *Attorney, Agent, or Firm* — Steinfl + Bruno LLP

(57) ABSTRACT

A packaging device for packaging articles into boxes including a mandrel, a handling unit, a first retaining device, and a closing unit. The mandrel is adapted to be wrapped at least partially by panels of a blank to form a partially closed box. The handling unit is configured to move said mandrel along a feed trajectory. The first retaining device is configured to retain at least a first panel of the blank wrapped at least partially on the mandrel. The closing unit is arranged to at least partially overlap and fix an outer panel onto an inner panel of the blank. The closing unit includes a hitting element movable along a displacement trajectory between a rest position, wherein the hitting element is in a position far from the mandrel, and a pressure position, wherein the hitting element is in a position such to press the outer panel on the inner panel and against a second abutment surface of the mandrel, and a displacement member configured to
(Continued)

displace the hitting element between the rest position and the pressure position.

18 Claims, 6 Drawing Sheets

(51) Int. Cl.

| | |
|---|---|
| ***B65B 11/10*** | (2006.01) |
| ***B65B 11/28*** | (2006.01) |
| ***B65B 43/10*** | (2006.01) |
| ***B65B 49/14*** | (2006.01) |

(58) Field of Classification Search
CPC ..... B65B 35/205; B65B 35/405; B65B 43/10; B65B 49/08; B65B 49/14
USPC ..... 53/574, 575, 220, 228, 230, 232, 233, 53/234
See application file for complete search history.

(56) References Cited

U.S. PATENT DOCUMENTS

| | | | | |
|---|---|---|---|---|
| 3,935,694 | A * | 2/1976 | Langen | B65B 11/004 493/131 |
| 4,221,107 | A | 9/1980 | Langen | |
| 6,125,611 | A | 10/2000 | Focke | |
| 2006/0162295 | A1 * | 7/2006 | Smith | B65B 11/10 53/566 |

* cited by examiner

PACKAGING DEVICE FOR PACKAGING ARTICLES INTO BOXES

CROSS REFERENCE TO RELATED APPLICATIONS

The present application is the U.S. national stage of International Application No. PCT/IB2023/055529 filed on May 30, 2023, which, in turn, claims priority to Italian Patent Application No. 102022000011699 filed on Jun. 1, 2022.

The present invention concerns a packaging device for packaging articles into boxes, particularly suitable for packaging articles in accordance with a process in which it is envisaged to form the box around the article to be packaged, known in the art as a "wrap-around" process.

The content of the following patent applications, filed on the same date by the same Applicant, is considered incorporated herein in its entirety:

Italian patent application entitled "Packaging device for packaging articles into boxes and relative packaging method"—file reference PBI17860;

Italian patent application entitled "Packaging unit for packaging articles into boxes and relative packaging method"—file reference PBI17861.

The present invention finds a preferred, although not exclusive, application in the field of packaging articles with variable geometry and that are relatively delicate into boxes, such as for example bags of corn flakes, a sector to which reference may be made below without however losing generality.

In particular, in the relevant technical field, it is known to package articles inside a box according to two distinct modes.

A first mode envisages a first step of forming a box, open at least at one end thereof, the subsequent insertion of the article to be packaged into the open box and, then, the closure of the open end. A second mode envisages instead that the box is formed by wrapping a blank, for example a shaped and creased cardboard, around a mandrel made of stiff material, for example made of metal and containing the article to be packaged. This mode envisages that the blank is wrapped around the mandrel so as to form a box closed laterally but open at one end thereof, from which the mandrel is then extracted leaving the article inside the newly formed box. Also in this case, the open end can be conveniently closed, so that the package thus made can be sent to the final packaging and shipment steps to the points of sale.

In this description as well as in the accompanying claims, some terms and ex-pressions are deemed to assume, unless otherwise expressly indicated, the meaning expressed in the following definitions.

The term "article" means any product which can be packaged into boxes.

The articles can have a predefined geometric shape or they can have a variable geometry.

Preferably, the articles are food and confectionery articles, either loose or contained inside bags or other types of wrapper, such as for example bags of cereals or coffee capsules or other brewing beverages, individual chocolates (wrapped or unwrapped), candies, pouches containing solid, liquid or semi-solid food products; in addition, articles from the ceramic industry, absorbing articles for sanitary use, articles from the tobacco industry, articles from the cosmetics industry, articles from the pharmaceutical industry, articles from the personal & home care industry.

By "packaging" of one or more articles into a box is meant that a box containing said one or more of said articles is obtained. Such packaging can be obtained by inserting one or more articles into an already formed box or, preferably, it can be obtained by forming a box around the one or more articles to be contained.

By "mandrel" is meant a container capable, on the one hand, of accommodating and supporting one or more articles to be packaged and, on the other hand, of providing an effective abutment for folding the blank when wrapped around it.

For this purpose, it should be specified that accommodating and the support of such one or more articles does not in itself imply that they must be entirely accommodated inside the mandrel or completely supported by it, but it is sufficient for them to be accommodated when the blank is wrapped around the mandrel.

Similarly, it should be specified that even the abutment of the blank does not in itself imply that the blank is abutted over its entire surface by the mandrel, but it is sufficient for it to be abutted to an extent so as to allow the correct folding necessary for the formation of the box.

In general terms, a first element "abuts" a second element when the first element touches the second element and is able to at least partially oppose to a relative displacement of the first element against the second element.

"Blank" means a shaped sheet of suitable material and thickness adapted to be wrapped by folding around a mandrel to form a box.

Preferably, the blank is made of cardboard.

Preferably, the blank has a thickness of at least 0.2 mm, more preferably less than 4 mm. In a most preferred manner, the blank has a thickness between 0.25 mm and 1.6 mm, more preferably between 0.3 mm and 1 mm, even more preferably between 0.4 and 0.8 mm.

"Box" means any container adapted to contain a plurality of articles for the purpose of packaging them, which can be made from a blank by folding around a mandrel and subsequent fixing at its panels.

A box is "partially closed" when the box has at least one closed contour section, more preferably it is closed laterally around the mandrel while the longitudinal ends are kept open.

A "folding line" of a blank is a predefined line around which two portions of the blank are envisaged to rotate relative to each other so as to fold the blank.

The folding line can be a virtual, albeit predefined, line.

The folding line is preferably defined by a weakening line obtained on the blank, e.g., a crease, or a scoring or a plurality of aligned holes.

"Panel" means a region of the blank bounded by edges of the blank and/or folding lines.

Some panels allow the mutual fixing of the blank in such a way as to form an at least partially closed box, preferably around a mandrel. Non-limiting examples of such a fixing are gluing, stapling and jointing by means of interlocking elements or elements with laces and hooks (Velcro®).

In particular, the fixing to form an at least partially closed box takes place by at least partially overlapping two panels of the blank, an inner panel and an outer panel.

Specifically, it is intended to indicate with "outer panel" the panel that, overlapped on the inner panel, is located outside the at least partially closed box, whereas it is intended to indicate with "inner panel" the panel that, overlapped on the outer panel, is located between it and the inside of the at least partially closed box.

By "movement unit" is meant any mechanism capable of moving the mandrel along a predefined path and can be represented by a conveyor driven by mechanical, pneumatic or hydraulic electric motors or other similar known systems capable of moving the mandrel along any trajectory, for example straight, curvilinear, closed-loop, circular.

Examples of movement units are the conveyor belts, the robotic arms and the carousels.

"Longitudinal direction" of an element means the direction along which an element is predominantly extended.

By "close distance" is meant a minimum distance not greater than 2 cm, preferably not greater than 1 cm, more preferably less than 0.5 cm.

Within the scope of the present invention, a range between two limit values is to be understood as that such values fall within said range, unless otherwise specified.

This range may be, by way of example only, a range of lengths, angles, percentages or other quantities.

Within the scope of the present invention, the trajectory of a moving element is always considered in relation to a fixed reference system, generally identifiable with the ground on which the packaging device is resting, unless specifically indicated otherwise.

Within the scope of the present invention, the inclination of one surface with respect to another surface is identified with the acute angle formed by the intersection of the planes in which such surfaces lie.

The Applicant has previously observed that the wrap-around type packaging process briefly illustrated above allows to obtain significant advantages in terms of production flexibility compared to the packaging process with insertion of the article in the preformed box. In fact, in the wrap-around type packaging process, the times to switch from one format to another or to bring new formats into production are significantly reduced.

However, the Applicant has observed that the wrap-around type packaging process illustrated above is often particularly complex and articulated, particularly when the articles contain delicate or crumbly products, like in the case of bags containing corn flakes. In fact, the latter can easily break forming crumbs and powders that lower the quality of the end product.

In particular, the Applicant has observed how one of the critical steps for packaging articles into a box by means of the wrap-around type packaging process is the closure of the blank once it is wrapped around the mandrel. This closure envisages a series of distinct operations, such as folding the flaps along a corresponding folding line and gluing them onto each other, which in turn envisages not only that the two panels are in their desired final relative position, but that they are kept in such position for the time necessary for the adhesive to effectively exert its function, i.e. that the two panels no longer move with respect to each other.

These operations may generally envisage that these panels have an appropriate abutting element.

The Applicant was able to assess that folding the panels onto each other along the corresponding folding line to overlap at least partially the panels and their gluing onto each other cannot take place by folding the panels and pressing them against the products, that is using the products as abutting elements, in particular when such articles are delicate or crumbly.

The Applicant has also observed that these operations of folding the panels and of gluing the panels themselves are typically carried out by different members, which make both the process and the wrap-around type packaging plant not flexible and complicated both from the realization and management point of view.

The Applicant has therefore felt the need to modify the wrap-around type packaging plant and the relative process taking into account that a simplification of the packaging operations could not, however, have dispensed with safeguarding the integrity of the articles to be packaged.

In response to this need, the Applicant has found that a device and a method for packaging articles into boxes that envisage that the operations of folding the panels and gluing the panels onto each other are carried out by a single closing unit against a mandrel greatly simplifies the wrap-around process and the relative packaging plant.

However, the Applicant has found that such a packaging device and relative packaging method may still be affected by the fact that the cardboard blank wrapped around the mandrel naturally tends to reopen, when it is not adequately retained in position before the mutual fixing of its panels.

In fact, in case it is not retained in this way, it can happen that the blank reopens, also even partially. This may result in the closing unit not properly fixing the blank around the mandrel or not fixing it at all.

In both cases, there is a need to discard the package obtained from this blank and possibly recover the articles contained therein to introduce them again into the packaging process.

The blank therefore, in order to avoid this, once wrapped around the mandrel must be kept in such position until the operations of folding the panels against the mandrel and of fixing the panels on each other are completed.

However, the Applicant has observed that the presence of an element that retains the blank wrapped around the mandrel may interfere with the handling of the closing unit itself.

The Applicant has also observed that this is further complicated by the fact that the mandrel itself is moved along a certain feed trajectory. In this case, in fact, it is envisaged that a hitting element of the closing unit is inserted in the forward trajectory of the mandrel just behind the mandrel itself, so as to fold the outer panel of the blank, and that it then follows the mandrel in a section of its forward trajectory, so as to press the outer panel of the blank against an abutment surface of the mandrel.

The Applicant has in particular observed that the need to insert the hitting element in the feed trajectory requires the provision of a free space that causes a discontinuity in the action of retaining the blank on the mandrel, and that as the handling speed of the mandrel increases, generally consequent to a high demand for production capacity of the packaging device, the amplitude of said free space increases, as well, with consequent decrease in the action of retaining the blank in the correct wrapping position around the mandrel.

The Applicant has understood that the problem could be solved by making sure that the hitting element of the closing unit had a geometric shape of the walls such that, when it is displaced to fit into the trajectory of the mandrel in order to fold the panels of the blank against the mandrel to fix them on each other, it manages to pass in very narrow spaces and at a close distance from the retaining device, so as to interfere as little as possible with the action of the device for retaining the blank around the mandrel.

The Applicant has therefore found that a device and a packaging method in which the hitting element has, between a front wall, intended to abut the mandrel, and a first wall adjacent to the front wall and intended to be facing the retaining device, a connecting wall tilted with respect to the front wall and to the first wall in a manner substantially analogous to the inclination of the displacement trajectory of the hitting element towards the mandrel, allows to pass at a close distance from the retaining device, in very narrow spaces, limiting to the maximum the discontinuity in the action of retaining the blank on the mandrel and thus preventing the blank from being able to reopen.

In a first aspect thereof, therefore, the present invention is directed to a packaging device for packaging articles into boxes comprising a mandrel.

Preferably said mandrel is configured to accommodate therein one or more of said articles.

Preferably said mandrel is adapted to be at least partially wrapped by a blank so as to allow the formation of a partially closed box.

Preferably said device for packaging articles into boxes comprises a handling unit configured to move said mandrel along a feed trajectory.

Preferably said packaging device for packaging articles into boxes comprises a first retaining device configured to cooperate with the mandrel along a first section of said feed trajectory.

Preferably, said first retaining device configured to cooperate with the mandrel along a first section of said feed trajectory by retaining at least a first panel of the blank at least partially wrapped on the mandrel.

Preferably said first panel of the blank is retained wrapped at least partially on the mandrel against a first abutment surface of the mandrel.

Preferably said first abutment surface is extended parallel to the feed trajectory.

Preferably said packaging device for packaging articles into boxes comprises a closing unit.

Preferably the closing unit is arranged to at least partially overlap and fix an outer panel of the blank onto an inner panel of the blank when the blank is at least partially wrapped onto the mandrel.

Preferably said closing unit comprises a hitting element.

Preferably said hitting element is extended along a prevailing longitudinal direction.

Preferably said hitting element is movable along a displacement trajectory between a rest position, in which the hitting element is in a position far from the mandrel, and a pressure position, in which the hitting element is in a position such to press the outer panel on the inner panel.

Preferably in such a pressure position the hitting element is in a position such to press the outer panel on the inner panel and against a second abutment surface of the mandrel.

Preferably in such a pressure position the hitting element is in a position such to press the outer panel on the inner panel and against a second abutment surface of the mandrel when said mandrel cooperates with said first retaining device.

Preferably said closing unit comprises a displacement member.

The displacement member may be any mechanism capable of moving the hitting element between the rest position and the pressure position along a predefined path and is represented by a conveyor driven by electric, mechanical, hydraulic or pneumatic motors or other similar systems capable of moving the hitting element along a displacement trajectory. An example of a displacement member are the robotic arms.

Preferably said displacement member is configured to displace the hitting element between the rest position and the pressure position.

Preferably said hitting element has a front wall comprising at least one contact surface adapted to abut said second abutment surface of the mandrel.

Preferably said hitting element has a first wall adjacent to the front wall and intended to be facing said first retaining device.

Preferably at least a portion of the longitudinal extension of the hitting element has at least a first connecting wall between said front wall and said first wall the first connecting wall being tilted with respect to said front wall and said first wall.

Preferably said first connecting wall is tilted with respect to said front wall and said first wall by an angle $\alpha$ greater than or equal to 0° and less than or equal to 20° with respect to said displacement trajectory. Preferably said first connecting wall is tilted with respect to said front wall and said first wall by an angle $\alpha$ greater than or equal to 0° and less than or equal to 20° with respect to said displacement trajectory, so that, when said hitting element moves along said displacement trajectory between the rest position and the pressure position, said first connecting wall of said hitting element passes at a close distance from said first retaining device.

It will be appreciated how it can thus be achieved that the hitting element overlaps and fixes the outer panel of the blank on the inner one while the blank is kept in its position in which it is partially wrapped around the mandrel despite this being simultaneously moved along a certain feed trajectory, even in conditions of high handling speed of the mandrel.

In this way, the blank is prevented from reopening, also even partially, when the hitting element is not yet in the pressure position, allowing to greatly improve the quality of the closure of the box and more generally the wrap-around type packaging plant as a whole even in conditions of high production capacity, as well as the relative packaging process.

The present solution, in at least one of the aforementioned aspects, may have at least one of the further preferred features set forth below.

In some embodiments said first retaining device comprises a main body and an extension extending away from said main body.

Preferably said extension extends away from said main body in a direction opposite to said feed trajectory.

Preferably said extension has a transverse dimension with respect to the feed trajectory smaller than the transverse dimension of said main body.

In other words, the extension has a width smaller than that of the main body.

In some embodiments the transverse dimension with respect to the feed trajectory of the extension of the first retaining device is in the range from 70 to 90 mm.

In some embodiments the dimension of the extension of the first retaining device parallel to the feed trajectory is in the range from 30 to 50 mm.

In some embodiments said extension is configured in such a manner that, when said hitting element moves along said displacement trajectory between the rest position and the pressure position, said first connecting wall of said hitting element passes at a close distance from said extension of said first retaining device.

In some embodiments the longitudinal dimension of said first connecting wall is at least equal to the dimension of said extension of said first transverse retaining device with respect to said feed trajectory.

It will be appreciated how, in this way, the retaining device exerts its function for as long as possible without interfering with the closing unit, in particular without interfering with the closing unit while the hitting element moves from the rest position to the pressure position.

At the same time, the first connecting wall can only be envisaged for a portion of the longitudinal dimension of the hitting element, so that, in its remaining part, the front wall can have its maximum extension, so as to exert a wider and more uniform pressure on the abutment surface of the mandrel.

Preferably the extension is extended from a central region of the main body. In this way, the extension exerts its retaining function in the optimal position, i.e. in the central position of the blank, and at the same time the front wall of the hitting element has its maximum surface at the end regions of the outer and inner panels, where a greater pressure efficiency is required.

In some embodiments, said first connecting wall is extended over a fraction between 10% and 60%, preferably between 20% and 50%, of the longitudinal dimension of the contact surface of the front wall.

In some embodiments said first connecting wall is tilted by an angle between 20° and 80°, preferably between 45° and 70°, more preferably by about 60°, with respect to said front wall.

In some embodiments said packaging device comprises a second retaining device.

Preferably said second retaining device is upstream of said first retaining device with respect to said feed trajectory.

In some embodiments said second retaining device is configured to cooperate with the mandrel along a second section of said feed trajectory upstream of said first section of said feed trajectory by retaining said at least one first panel of the blank wrapped at least partially on the mandrel against said first abutment surface of the mandrel.

In some embodiments said second retaining device is separated from said first retaining device to allow passage of said hitting element between the rest position and the pressure position along said displacement trajectory.

It will be appreciated that, with this arrangement, the blank is retained partially wrapped around the mandrel along the feed trajectory both upstream and downstream of the section in which the hitting element passes from the rest position to the pressure position, further improving the retention of the partially wrapped blank around the mandrel.

In some embodiments said hitting element comprises at least one second connecting wall opposite to said first connecting wall.

Preferably, the second connecting wall is tilted with respect to said front wall and said first wall by an angle $\alpha$ between 0° and 20° with respect to said displacement trajectory.

In one embodiment, said second connecting wall is extended between said front wall and said first wall.

In another embodiment, said hitting element comprises a second wall adjacent to the front wall and opposite to said first wall, and a rear wall adjacent to the second wall and opposite to the front wall.

Preferably said second connecting wall is extended between said rear wall and said second wall.

Preferably, when said hitting element moves along said displacement trajectory between the rest position and the pressure position, said second connecting wall of said hitting element passes at a close distance from said second retaining device.

This allows to reduce the distance between the two retaining devices to the minimum necessary to have the hitting element pass between them in its displacement between the rest and pressure position.

In some embodiments said first connecting wall and second connecting wall of said hitting element are parallel.

In some embodiments said second retaining device comprises a main body and an extension extending away from said main body in a direction concordant with said feed trajectory, said extension being configured in such a manner that, when said hitting element moves along said displacement trajectory between the rest position and the pressure position, said second connecting wall of said hitting element passes at a close distance from said extension of said second retaining device, the longitudinal dimension of said second connecting wall being at least equal to the longitudinal dimension of said extension of said second retaining device.

In this way, both retaining elements exert their function for as long as possible without interfering with the closing unit, in particular without interfering with the closing unit while the hitting element moves from the rest position to the pressure position.

Preferably said extension of said second retaining device has a transverse dimension with respect to the feed trajectory smaller than the transverse dimension of said main body.

In other words, the extension has a width smaller than that of the main body of the second retaining device.

In some embodiments the transverse dimension with respect to the feed trajectory of the extension of the second retaining device is in the range from 70 to 90 mm.

In some embodiments the dimension of the extension of the second retaining device parallel to the feed trajectory is in the range from 30 to 50 mm.

In some embodiments said extension is configured in such a manner that, when said hitting element moves along said displacement trajectory between the rest position and the pressure position, said second connecting wall of said hitting element passes at a close distance from said extension of said second retaining device.

In some embodiments the longitudinal dimension of said second connecting wall is at least equal to the dimension of said extension of said second transverse retaining device with respect to said feed trajectory.

It will be appreciated how, in this way, the second retaining device exerts its function for as long as possible without interfering with the closing unit, in particular without interfering with the closing unit while the hitting element moves from the rest position to the pressure position.

At the same time, the second connecting wall can only be envisaged for a portion of the longitudinal dimension of the hitting element.

Preferably the extension is extended from a central region of the main body of the second retaining device.

In this way, the extension exerts its retaining function in the optimal position, i.e. in the central position of the blank.

In the pressure position the longitudinal direction of the hitting element is perpendicular to the feed trajectory and therefore parallel to the transverse dimension of the extension of the first retaining device and of the extension of the second retaining device. In some embodiments said second connecting wall is tilted by an angle between 20° and 80°, preferably between 45° and 70°, more preferably by about 60°, with respect to said rear wall.

According to some embodiments said first retaining device and/or said second retaining device comprise a plate-shaped element.

It will be appreciated how, in this way, the retaining devices can be both structurally simple and effective in their purpose.

In some embodiments said plate-shaped elements are coplanar. In this way, the handling of the mandrel and of the blank along the feed trajectory in the section that runs from the beginning of the plate-shaped element of the second retaining device to the end of the plate-shaped element of the first retaining device can also take place on a plane.

In particular, this plane will be parallel to the plane on which the plate-shaped elements lie.

In some embodiments each of said first and second retaining devices are fixed with respect to said feed trajectory. Preferably, each of said first and second retaining devices are engaged to a fixed structure of said packaging device.

In some embodiments said displacement trajectory is a straight trajectory with respect to said mandrel.

Preferably said displacement trajectory is tilted at an angle β in the range from 10° to 60°, more preferably from 20° to 45°, with respect to such second abutment surface of the mandrel.

In some embodiments the closing unit is assembled on said handling unit configured to move said mandrel along said feed trajectory.

In some embodiments, said handling unit is configured to move both the mandrel and the closing unit along a circular feed trajectory.

Preferably said unit comprises a carousel, preferably a vertical axis carousel.

In these cases, it will be noted that the displacement trajectory of the hitting element with respect to a fixed reference system is given by the composition of the movement of the hitting element with respect to the mandrel with the movement of the mandrel with respect to the fixed reference system.

In some embodiments the packaging device comprises a plurality of mandrels and a closing unit for each mandrel.

Preferably the outer panel and/or the inner panel are at least partially separated from the rest of the blank by a folding line. Preferably the outer panel and/or the inner panel are folded along a folding line thereof.

Preferably the outer panel and/or the inner panel are folded along a folding line thereof by the closing unit.

In some embodiments, the folding line is formed by a crease or by a scoring line or by a line of holes formed on the blank.

In this way the folding of the panel along the folding line is particularly facilitated.

In a preferred embodiment, at least one of said two outer and inner panels bears an adhesive on an overlapping surface with the other panel.

In some embodiments, the adhesive is a glue.

In one embodiment, the adhesive is a glue and the hitting element is such to press, in the pressure position, the outer panel on the inner panel and against the second abutment surface of the mandrel, preferably for a time equal to or greater than the drying time of the glue.

In this way the box is closed permanently, avoiding problems of detachment or in-sufficient adhesion between the outer and inner panels.

In some embodiments, the preliminary blank is at least partially creased.

This makes the closing process easier to execute.

Preferably, the blank is creased at the upper panel and/or the lower panel, more preferably at both panels.

The packaging of articles into boxes can comprise the following steps:

a) providing a blank, at least partially wrapped around a mandrel containing therein one or more of said articles, so as to form a partially closed box around said mandrel and in such a way that the blank has a first panel of the blank wrapped at least partially on the mandrel against a first abutment surface of the mandrel and an outer panel and an inner panel, so that the outer panel can be at least partially overlapped on the inner panel against a second abutment surface of the mandrel, the outer panel and the inner panel being fixable on each other when pressed against each other;

b) at least partially folding the inner panel towards the second abutment surface of the mandrel;

c) at least partially folding the outer panel towards the second abutment surface of the mandrel;

d) moving said mandrel along a feed trajectory;

c) having said mandrel cooperate with a first retaining device for retaining said first panel of the blank against said first abutment surface of the mandrel, said first abutment surface being extended parallel to the feed trajectory, f) providing a hitting element movable along a displacement trajectory between a rest position, wherein the hitting element is in a position far from the mandrel, and a pressure position, wherein the hitting element is in a position such to press the outer panel on the inner panel and against said second abutment surface of said mandrel when said mandrel cooperates with said first retaining device, said second abutment surface being orthogonal to said first abutment surface and orthogonal to a plane where said feed trajectory lies, said hitting element having a front wall comprising at least one contact surface adapted to abut said second abutment surface of the mandrel, a first wall adjacent to the front wall and intended to be facing said first retaining device, at least a portion of the longitudinal extension of the hitting element having at least a first connecting wall between said front wall and said first wall tilted with respect to said front wall and said first wall by an angle α with $0° \leq \alpha \leq 20°$ with respect to said displacement trajectory of the hitting element with respect to said mandrel, g) moving said hitting element from said rest position to said pressure position so as to fix the outer flap on the inner flap along said displacement trajectory making sure that, during this displacement, said first connecting wall of said hitting element passes at a close distance from said first retaining device.

It should be specified that some steps of this method may be independent of the order of execution indicated. In addition, some steps may be optional. In addition, some steps of the method may be performed repetitively, or they may be performed in series or in parallel with other steps of the method.

The features and advantages of the present solution will become clearer from the detailed description of an embodiment thereof shown, by way of non-limiting example, with reference to the appended drawings in which.

FIGS. 10*a* to 10*f* are respective schematic representations of a method for packaging articles into boxes made with the device in accordance with this solution.

Figure 1:
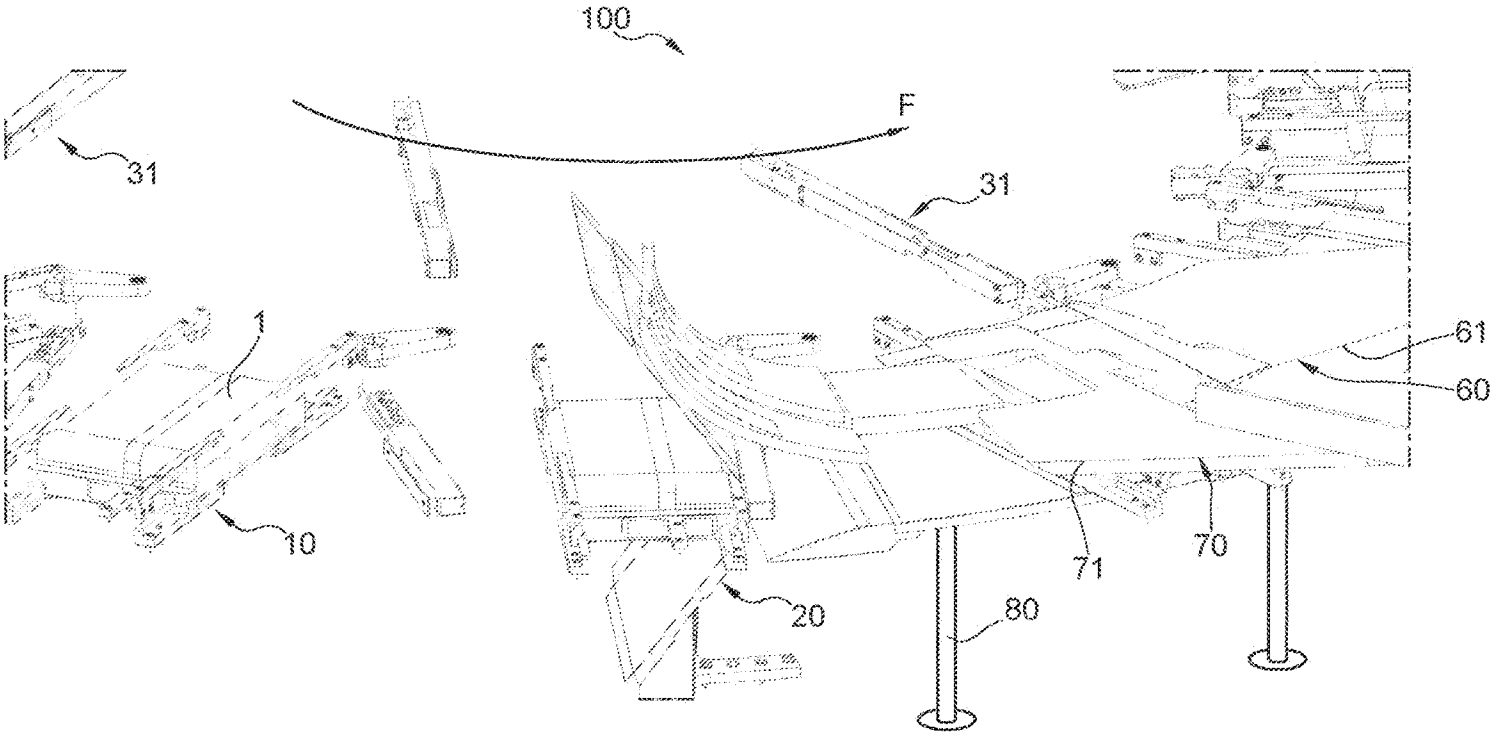
FIG. 1 is a partial schematic and perspective view from above of an example of packaging device for packaging articles into boxes made in accordance with this solution in a first operative configuration.

With initial reference to FIG. 1, an example of a packaging device made in accordance with this solution is indicated overall with 100.

The packaging device 100 is arranged to package one or more articles 1 inside boxes 2.

The articles 1 are, in this preferred embodiment, bags of granular, loose or bulk food products, for example corn flakes, in particular bags with a longitudinal dimension of about 300 mm (exemplary value).

The packaging device 100 comprises a plurality of mandrels and a handling unit 50 for handling such mandrels 10, not shown in FIG. 1. Such a handling unit 50 preferably comprises a carousel 51 rotatable about a vertical axis.

The handling unit 50 moves the plurality of mandrels 10 along a feedtrajectory F defining a substantially circular path.

Each mandrel 10 has its own closing unit 30 and each closing unit 30 is assembled on the handling unit 50, so that said handling unit 50 moves both each mandrel 10 and the corresponding closing unit 30 along the feed trajectory F.

The mandrel 10 is configured to accommodate therein one or more of said articles 1. It is furthermore adapted to be wrapped at least partially by a blank 20 of cardboard so as to form a partially closed box 210.

Figure 6:
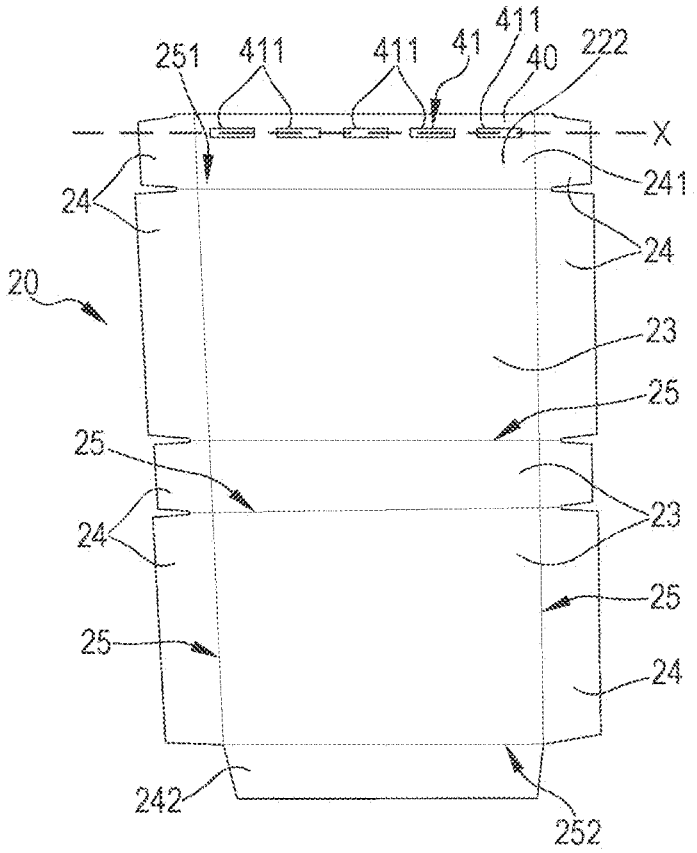
FIG. 6 is a schematic view of a blank.

The blank 20, an example of which is shown in FIG. 6, provides for a series of panels 23 adapted to form as such the sides of the box 2 and of the panels 24, 241, 242 adapted to overlap with other panels 24, 241, 242.

The panels 24, 241, 242 and the panels 23 may be creased along a folding line 25, 251, 252 so as to be more easily folded to form the box 2.

In particular, the blank 20 is shaped such that, once wrapped at least partially around the mandrel 10, the two panels 241, 242 are overlappable on each other when folded towards each other along the corresponding folding line 251, 252.

Figures 10, 10A, 10B, 10C, 10D, 10E, 10F:
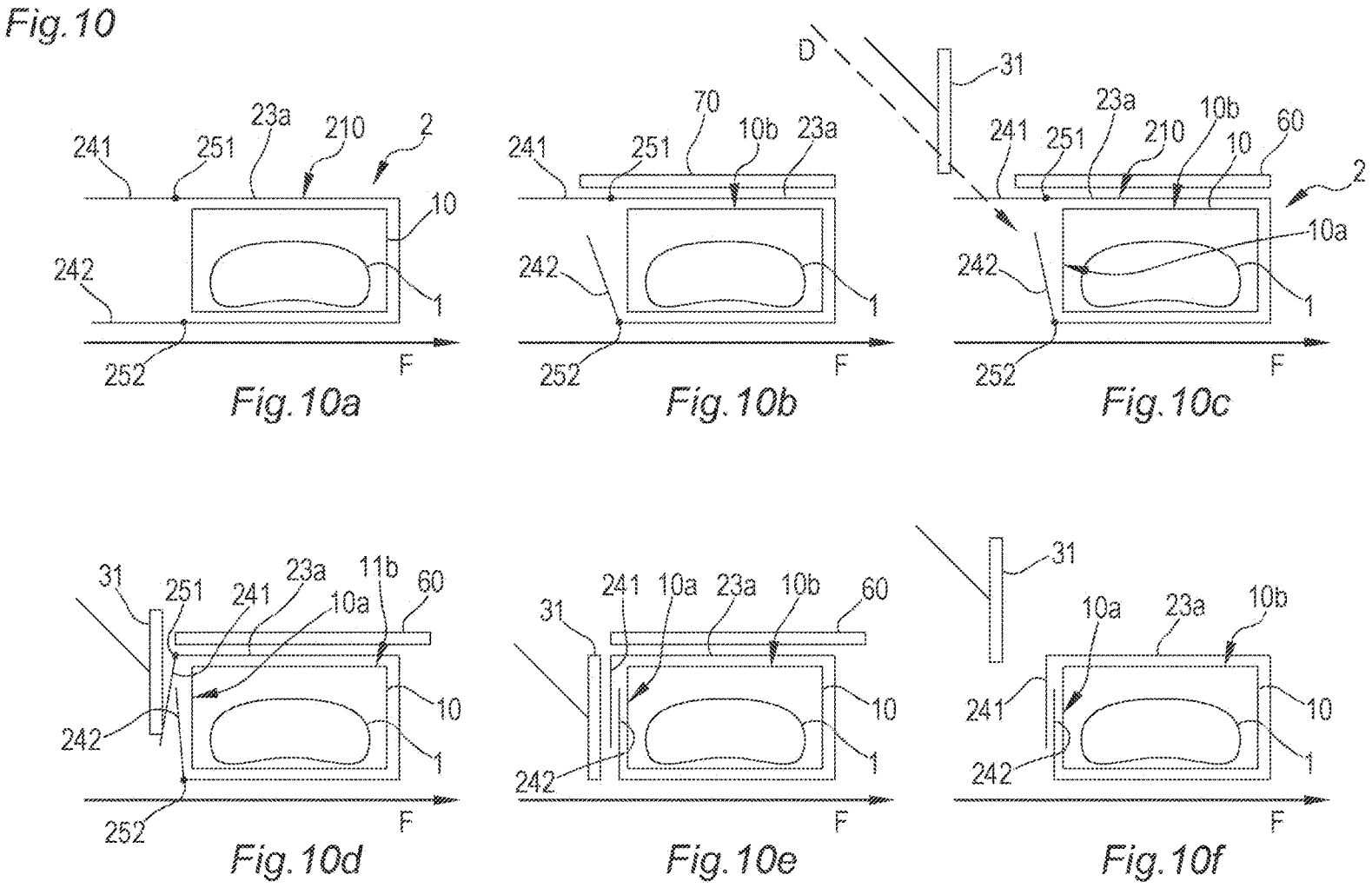

The blank 20 is of such a shape that, once wrapped at least partially around the mandrel 10, the two panels 241, 242 overlap on each other abutting the mandrel 10 on a second abutment surface 10*a* thereof, as shown in FIG. 10*c*.

The panel 241, once this overlap has been made, will be located outside the partially closed box 210; said panel 241 is the so-called outer panel 241.

In a completely similar way, the panel 242, once this overlap has been made, will be located between the outer panel 241 and the inside of the partially closed box 210; said panel 242 is the so-called inner panel 242.

At least one of the two panels 241, 242 further bears an adhesive 40 on an overlapping surface 222 with the other panel 241, 242, as shown in FIG. 6.

The adhesive 40 is a glue 41 distributed in glue points 411.

Still with reference to FIG. 6, the glue points 411 are spaced apart stepwise along an axis X parallel to the folding lines 251 and 252.

In some embodiments, the glue points 411 can only be located at the end regions of the panels 241, 242.

Still with reference to FIG. 6, it is the outer panel 241 that bears, on its overlapping surface 222, such glue points 411.

Figure 2:
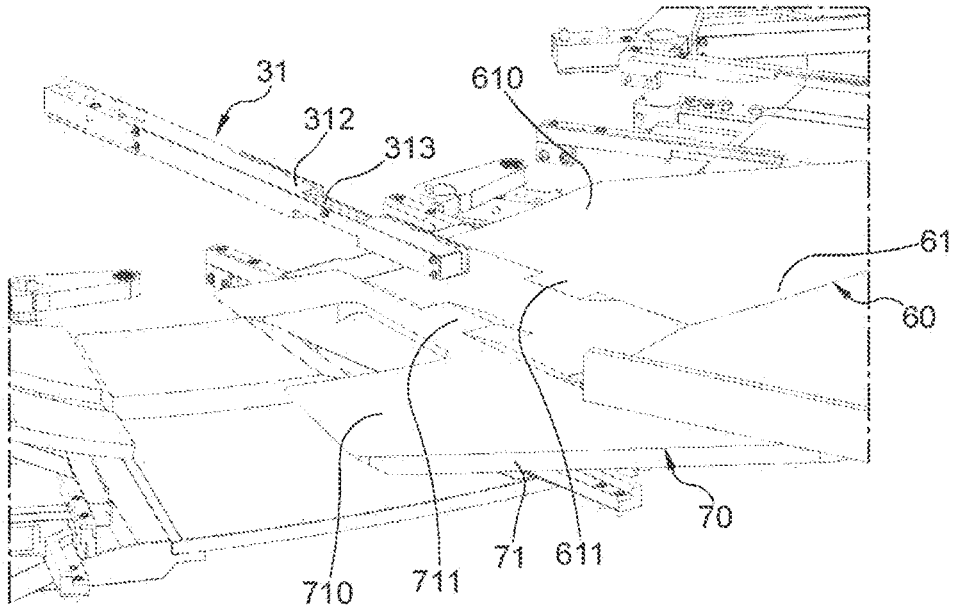
FIG. 2 is a partial schematic and perspective view from above of a detail of the device of FIG. 1.
Figure 3:
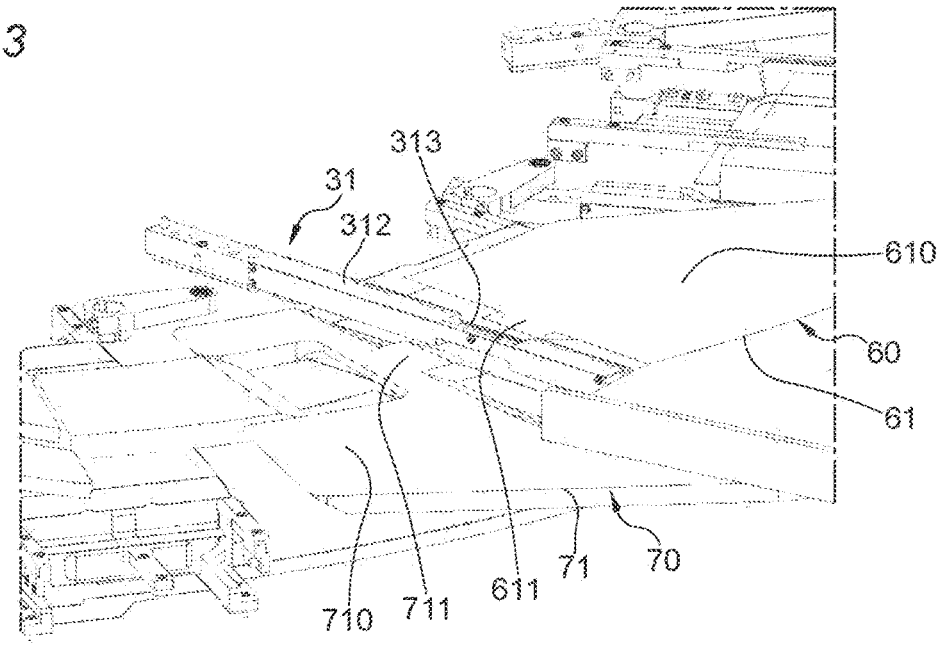
FIG. 3 is a partial schematic and perspective view from above of the detail of the device of FIG. 2 in a second operative configuration.

The device 100 further comprises two retaining devices 60,70 arranged spaced apart and in series along the feed trajectory F, as visible in FIGS. 1-3.

In particular, the first retaining device 60 is arranged along the feed trajectory F after the second retaining device 70.

The blank 20, once wrapped at least partially around the mandrel 10, is retained in such a wrapped form by means of such retaining devices 60,70.

The first retaining device 60 comprises a main body 610 and an extension 611 extending away from the main body 60 in the direction opposite to the feed trajectory F, towards the second retaining device 70, while the second retaining device 70 comprises a main body 710 and an extension 711 extending away from the main body 70 in a direction concordant with the feed trajectory F, towards the first retaining device 60.

The transverse dimension with respect to the feed trajectory of the extension of the first retaining device and of the extension of the second retaining device is approximately 79 mm, while the dimension parallel to the feed trajectory is approximately 42 mm.

With reference to FIGS. 1-3, said retaining devices 60,70 are two plates 61,71, coplanar to each other and parallel to the feed trajectory F and engaged to a fixed structure 80.

Both plates 61,71 cooperate with the mandrel 10 by retaining a first panel 23*a* of the blank against a first abutment surface 10*b* of the mandrel 10 extended parallel to the feed trajectory F.

Figure 4:
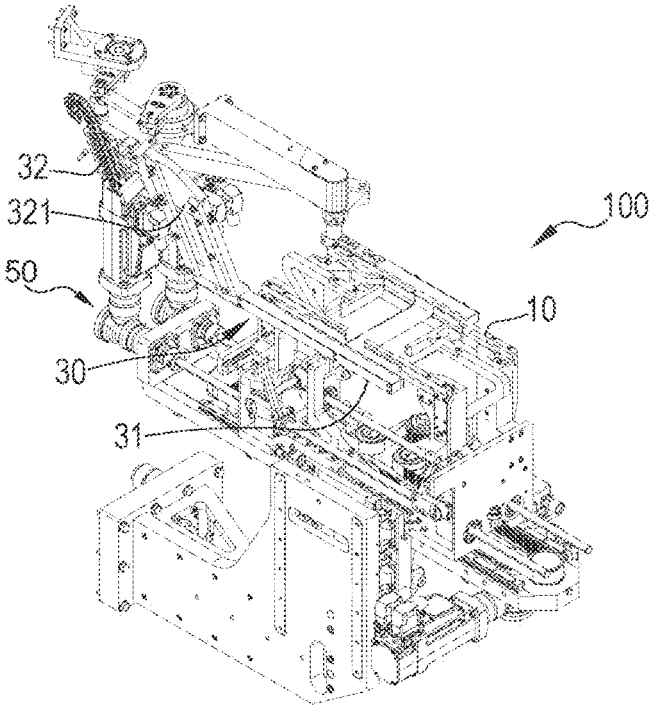
FIG. 4 is a partial schematic and left side perspective view of a component of the device of FIG. 1.
Figure 5:
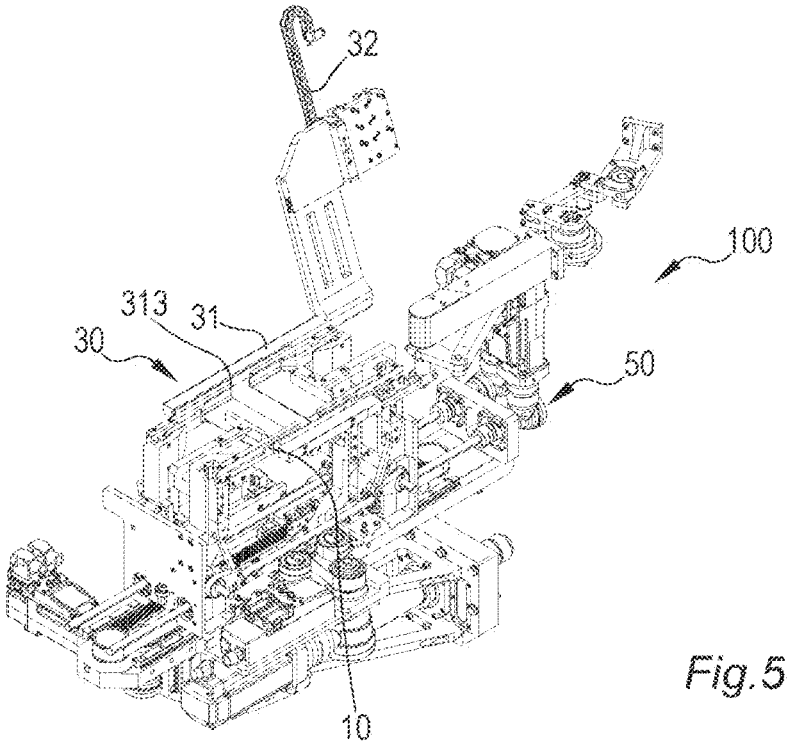
FIG. 5 is a partial schematic and right side perspective view of the figure component.

FIGS. 4 and 5 relate to a detail of the packaging device 100 in which the closing unit 30 and the mandrel 10 are visible.

Each closing unit 30 comprises a displacement member 32 and a hitting element 31 movable with respect to the mandrel 10 between a rest position, in which the hitting element 31 is in a position far from the mandrel 10 and a pressure position, in which the hitting element 31 is in a position such to press the outer panel 241 on the inner panel 242 and against the second abutment surface 10*a* of the mandrel 10.

The displacement member 32 moves the hitting element 31 between the rest and pressing positions.

Said displacement member 32 comprises an articulated arm 321 which actuates the displacement of the hitting element 31 between the rest and pressure positions along a displacement trajectory D.

Figure 7:
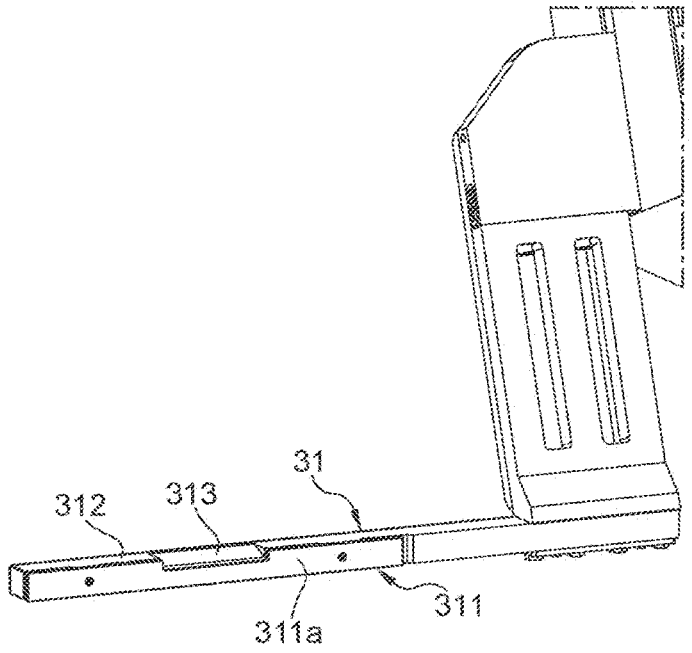
FIG. 7 is a partial schematic and left side perspective view from above of a detail of the device of FIG. 1.
Figure 8:
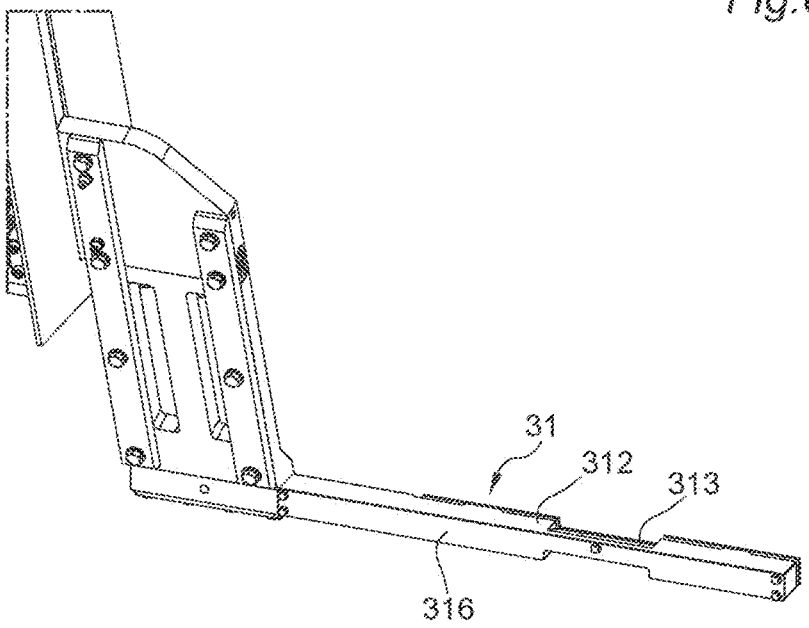
FIG. 8 is a partial schematic and right side perspective view from above of the detail of FIG. 7.
Figure 9:
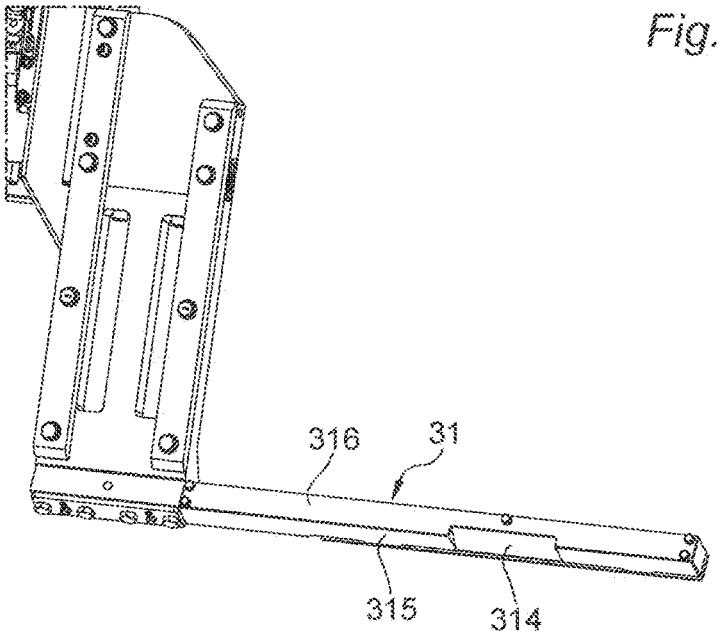
FIG. 9 is a partial schematic and right side perspective view from below of the detail of FIG. 7.

With reference to FIGS. 7-9, the hitting element 31 comprises a front wall 311 on which a contact surface 311*a* is defined which is adapted to abut the second abutment surface of the mandrel 10*a* when the hitting element 31 is in a pressure position, a first wall 312 adjacent to the front wall 311 and intended to be facing the two retaining devices 60,70, a second wall 315 adjacent to the front wall 311 and opposite to said first wall 312, a rear wall 316 adjacent to the second wall 315 and to the first connecting wall 311 and opposite to the front wall 311.

The hitting element 31 has a first connecting wall 313 extended between the front wall 311 and the first wall 312;

said first connecting wall 313 is tilted with respect to the front wall 311 and said first wall 312 by an angle of 70° with respect to the front wall.

This angle makes the first connecting wall substantially parallel to the displacement trajectory D.

The connecting wall has a longitudinal dimension of approximately 100 mm and has a rectangular shape.

The hitting element 31 further has a second connecting wall 314 extended between the rear wall 316 and the second wall 315 and opposite to the first connecting wall 313 and tilted with respect to the rear wall 316 and said second wall 315 by an angle of 70° with respect to the rear wall 316.

The blank 20 is preliminarily wrapped around the mandrel 10 so as to be able to form a partially closed box (FIG. 10*a*) and kept in such position by the second retaining device 70 (FIG. 10*b*) while advancing along a first section of the feed trajectory F.

In particular, the retaining device 70 retains the panel 23*a* of the blank 20 against the first abutment surface 10*b* of the mandrel 10.

Subsequently, in a second section of the feed trajectory F, the blank 20 is kept in such position by the first retaining device 60 (FIG. 10*c*) while advancing along the feed trajectory F.

In particular, the first retaining device 60 retains the panel 23*a* of the blank 20 against the first abutment surface 10*b* of the mandrel 10. The hitting element 31, in passing from the rest position to the pressure position, moves along the displacement trajectory D approaching the mandrel 10 from the side of the outer 241 and inner 242 panels of the blank 20 (FIG. 10*a*) until it meets the outer panel 241.

The approach of the hitting element 31 to the mandrel 10 from the rest position to the pressure position takes place with a displacement trajectory D that with respect to the abutment surface 10*a* of the mandrel 10, is rectilinear and tilted by an angle of about 20° with respect to the abutment surface 10*a* of the mandrel 10, as visible in FIG. 10*c*.

By continuing its approach towards the mandrel 10, the hitting element 31 folds the outer panel 241 against the mandrel 10 along a corresponding folding line 251. The outer panel 241, by folding against the mandrel 10 along the folding line 251, meets the inner panel 242, which is already preliminarily at least partially folded along a corresponding folding line 252 towards the mandrel 10 itself (FIG. 10*d*).

By continuing further in its approach to the mandrel 10, the hitting element 31 continues to fold the outer panel 241 towards the mandrel 10; the outer panel 241 in turn, in its folding movement, further folds the inner panel 242 against the mandrel 10 until it abuts the mandrel 10 itself on the abutment surface 10*a* (FIG. 10*e*).

In particular, the hitting element 31 passes from the rest position to the pressure position until it abuts the mandrel 10 in the second abutment surface 10*a* passing at a close distance from both the retaining device 70 and the retaining device 60 and in particular passing at a close distance from both the extension 711 of the retaining device 70 and the extension 611 of the retaining device 60, as visible in FIG. 3.

More particularly, the first connecting wall 313 of the hitting element 31 passes at a close distance from the extension 611 and the second connecting wall 314 of the hitting element 31 passes at a close distance from the extension 711, for example at a distance not greater than 2 cm, preferably not greater than 1 cm, more preferably less than 0.5 cm.

In this way the distance between the extension 611 of the first retaining device 60 and the extension 711 of the second retaining device 70 can be particularly reduced, so as to ensure on the one hand the passage of the hitting element 31 and on the other hand the continuous retaining of the first panel 23*a* of the blank 20 by means of the retaining devices 60,70 against the first abutment surface 10*b* of the mandrel 10 until the hitting element 31 has arrived at the pressure position.

It goes without saying that, in order to meet specific and contingent application needs, a person skilled in the art will be able to make further modifications and variants to the solution described above that are nevertheless within the scope of protection as defined by the following claims.

The invention claimed is:

1. A packaging device for packaging articles into boxes comprising:

a mandrel configured to accommodate therein one or more of said articles and configured to be at least partially wrapped by panels of a blank to allow a formation of a partially closed box, a handling unit configured to move said mandrel along a feed trajectory;

a first retaining device configured to cooperate with the mandrel along a first section of said feed trajectory by retaining at least a first panel of the blank at least partially wrapped on the mandrel against a first abutment surface of the mandrel, said first abutment surface extended parallel to the feed trajectory, and a closing unit arranged to at least partially overlap and fix an outer panel of the blank onto an inner panel of the blank when the blank is at least partially wrapped onto the mandrel, the closing unit comprising:

a hitting element extended along a prevailing longitudinal direction and movable along a displacement trajectory between a rest position, wherein the hitting element is in a position far from the mandrel, and a pressure position, wherein the hitting element is in a position to press the outer panel on the inner panel and against a second abutment surface of the mandrel when said mandrel cooperates with said first retaining device; and a displacement member configured to displace the hitting element between the rest position and the pressure position, said hitting element comprising:

a front wall comprising at least one contact surface adapted to abut said second abutment surface of the mandrel, a first wall adjacent to the front wall and intended to be facing said first retaining device, at least a portion of a longitudinal extension of the hitting element having at least a first connecting wall between said front wall and said first wall tilted with respect to said front wall and said first wall by an angle $\alpha$ between 0° and 20° with respect to said displacement trajectory;

wherein, when said hitting element moves along said displacement trajectory between the rest position and the pressure position, said first connecting wall of said hitting element passes at a distance of 2 cm or less from said first retaining device.

2. The packaging device for packaging articles into boxes according to claim 1, wherein:

said first retaining device comprises a main body and an extension extending away from said main body in a direction opposite to said feed trajectory, said extension configured such that, when said hitting element moves along said displacement trajectory between the rest position and the pressure position, said first connecting wall of said hitting element passes at a distance of 2 cm or less from said extension of said first retaining device, a longitudinal dimension of said first connecting wall being at least equal to a transverse dimension of said extension of said first retaining device.

3. The packaging device for packaging articles into boxes according to claim 1, said packaging device further comprising:

a second retaining device upstream of said first retaining device with respect to said feed trajectory, the second retaining device configured to cooperate with the mandrel along a second section of said feed trajectory upstream of said first section of said feed trajectory by retaining said at least one first panel of the blank at least partially wrapped on the mandrel against said first abutment surface of the mandrel, said second retaining device being separated from said first retaining device to allow passage of said hitting element between the rest position and the pressure position along said displacement trajectory.

4. The packaging device for packaging articles into boxes according to claim 3, wherein said hitting element further comprises at least a second connecting wall opposite to said first connecting wall and tilted with respect to said front wall and said first wall by an angle $\alpha$ between 0° and 20° with respect to said displacement trajectory, wherein, when said hitting element moves along said displacement trajectory between the rest position and the pressure position, said second connecting wall of said hitting element passes at a distance of 2 cm or less from said second retaining device.

5. The packaging device for packaging articles into boxes according to claim 4, wherein said first connecting wall and second connecting wall of said hitting element are parallel.

6. The packaging device for packaging articles into boxes according to claim 4, wherein:

said second retaining device comprises a main body and an extension extending away from said main body in a direction concordant with said feed trajectory, said extension configured such that, when said hitting element moves along said displacement trajectory between the rest position and the pressure position, said second connecting wall of said hitting element passes at a distance of 2 cm or less from said extension of said second retaining device, a longitudinal dimension of said second connecting wall being at least equal to a longitudinal dimension of said extension of said second retaining device.

7. The packaging device for packaging articles into boxes according claim 3, wherein at least one of said first retaining device and said second retaining device comprises a plate-shaped element.

8. The packaging device for packaging articles into boxes according to claim 7, wherein each of said first retaining device and second retaining device comprises a plate-shaped element, said plate-shaped elements being coplanar.

9. The packaging device for packaging articles into boxes according to claim 8, wherein each of said first retaining device and second retaining device are fixed with respect to said feed trajectory.

10. The packaging device for packaging articles into boxes according to claim 8, wherein each of said first retaining device and second retaining device are fixed with respect to said feed trajectory and engaged to a fixed structure of said packaging device.

11. The packaging device for packaging articles into boxes according to claim 1, wherein said displacement trajectory is a straight trajectory with respect to said mandrel.

12. The packaging device for packaging articles into boxes according to claim 11 wherein said displacement trajectory is tilted at an angle $\beta$ in the range from 10° to 60° with respect to such second abutment surface of the mandrel.

13. The packaging device for packaging articles into boxes according to claim 12 wherein the angle $\beta$ is in the range from 20° to 45°.

14. The packaging device for packaging articles into boxes according to claim 1, wherein the closing unit is assembled on said handling unit.

15. The packaging device for packaging articles into boxes according to claim 14, wherein said handling unit comprises a carousel.

16. The packaging device for packaging articles into boxes according to claim 1, wherein said handling unit is configured to move both the mandrel and the closing unit along a circular-type feed trajectory.

17. The packaging device for packaging articles into boxes according to claim 16, wherein said handling unit comprises a carousel.

18. The packaging device for packaging articles into boxes according to claim 1, wherein the packaging device comprises:

a plurality of mandrels and a closing unit for each mandrel of said plurality of mandrels.

* * * * *